US006250003B1

(12) United States Patent
Phinney

(10) Patent No.: US 6,250,003 B1
(45) Date of Patent: Jun. 26, 2001

(54) MULTI-SIDED DISPLAY DEVICE

(76) Inventor: Jeff B. Phinney, Unit 41, 2344 Barton St. East, Hamilton, Ontario (CA), L8E 3G6

( * ) Notice: Subject to any disclaimer, the term of this patent is extended or adjusted under 35 U.S.C. 154(b) by 0 days.

(21) Appl. No.: 09/472,713

(22) Filed: Dec. 24, 1999

(51) Int. Cl.[7] ..... G09F 15/00

(52) U.S. Cl. ..... 40/607; 40/333; 40/611; 40/655

(58) Field of Search ..... 40/333, 369, 606, 40/607, 611, 655, 660; D20/41

(56) References Cited

U.S. PATENT DOCUMENTS

| | | | | |
|---|---|---|---|---|
| 2,262,873 | * | 11/1941 | Wise | 40/607 |
| 2,616,196 | * | 11/1952 | Sandahl, Jr. et al. | 40/607 |
| 2,625,762 | * | 1/1953 | McColl | 40/607 |
| 3,167,874 | * | 2/1965 | Pogue | 40/607 |
| 3,928,930 | | 12/1975 | Attwood . | |
| 4,347,678 | | 9/1982 | Laakso . | |
| 4,353,179 | | 10/1982 | Jennings . | |
| 4,662,096 | | 5/1987 | Bayless et al. . | |
| 4,742,630 | * | 5/1988 | Scumaci | 40/607 X |
| 4,872,149 | | 10/1989 | Speas . | |
| 5,623,778 | * | 4/1997 | Dunn | 40/574 X |
| 5,903,520 | | 5/1999 | Dee et al. . | |

FOREIGN PATENT DOCUMENTS

| | | | | |
|---|---|---|---|---|
| 584673 | * | 2/1925 | (FR) | 40/607 |

* cited by examiner

*Primary Examiner*—Brian K. Green
(74) *Attorney, Agent, or Firm*—Dale J. Ream

(57) ABSTRACT

A multi-sided display device comprises a plurality of panels adapted to be releasably coupled to the pole of a conventional parking meter. The device includes a first panel and a terminal panel with at least one intermediate panel therebetween. The panels are pivotally coupled together with the terminal panel selectively coupled to the first panel. At least one panel includes a resilient U-shaped bracket mounted to the interior surface thereof for releasably coupling the panels to the pole. The panels are pivotal about a vertical axis defined by the pole between a closed configuration wherein the terminal panel is secured to the first panel and an open configuration wherein the intermediate and terminal panels are pivoted away from the first panel. The exterior face of each panel includes a display compartment for retaining advertising media. A door having a window is pivotally coupled to the display compartment such that advertising media can be inserted or exchanged therein. The display device further includes lock assemblies for limiting access to the display compartment and the space formed by the panels in the closed configuration.

17 Claims, 6 Drawing Sheets

MULTI-SIDED DISPLAY DEVICE

BACKGROUND OF THE INVENTION

This invention relates generally to devices for displaying signs or other advertising material and, more particularly, to a display device for attachment to the pole of a parking meter.

Various methods and apparatus have been proposed for advertising products or services to the public, including billboards, signs, posters, print ads, etc. In particular, signs supported by or mounted to posts have been proposed in U.S. Pat. Nos. 4,353,179, 4,662,096, and 4,347,678. Although assumably effective for their intended purposes, these devices are not particularly suited for displaying advertising materials on or about a conventional parking meter.

Therefore, it is desirable to have a display device which can be mounted to a conventional parking meter. It is also desirable to have a display device which can be viewed from a vehicle parked in front of a parking meter as well as by pedestrians walking in either direction on an adjacent sidewalk. Further, it is desirable to have a display device in which advertisements are inaccessible to pedestrians but can be easily changed by authorized personnel.

SUMMARY OF THE INVENTION

Therefore, a multi-sided display device for mounting to the pole of a parking meter utilizes at least three rectangular panels, each panel having interior and exterior surfaces. The first panel is pivotally coupled to the second panel which, in turn, is pivotally coupled to the third panel. The free sides of the first and third panels are releasably coupled to one another, as desired by a user. The second and third panels are pivotal in the direction of the interior surface of the first panel. Each panel extends between top and bottom equilateral triangular end walls, each end wall having an arcuate cutout in its free apex for extension of the parking meter pole therethrough when mounted thereto.

A U-shaped mounting bracket is mounted to the interior surface of the first and third panels for mounting the panels to the pole of a parking meter. The bracket includes a pair of spaced apart free ends which are forced apart when pressed against the pole during mounting. The free ends return to a non-expanded position when the pole is completely inserted into the bracket and is thus held thereby. The brackets of the first and third panels are positioned at different vertical heights so as not to interfere with one another during mounting. Therefore, the first panel can be mounted to the pole while the second and third panels are pivoted away from the first panel. The second and third panels can then be pivoted in the direction of the interior surface of the first panel until the bracket of the third panel engages the pole. In this closed configuration, the triangular end walls and the panels form an equilateral triangular configuration.

A door frame having a transparent material such as Plexiglas therein is pivotally coupled to each panel and is movable between open and closed positions. The door is slightly offset from the exterior surface such that a compartment is formed therebetween. Thus, the door can be opened to insert or replace a printed advertisement or other item to be displayed. The exterior surface is formed of a cork material to which advertisements can be pinned, tacked, etc. if otherwise too small to stand on their own. Each door as well as the first panel includes a lock assembly for limiting access to the compartment and interior space of the closed panels, respectively. A display device having more than three panels can be constructed in a substantially similar manner.

Therefore, a general object of this invention is to provide a multi-sided display device which can be mounted to the pole of a conventional parking meter.

Another object of this invention is to provide a display device, as aforesaid, having multiple panels which can be viewed both from street and sidewalk positions.

Still another object of this invention is to provide a display device, as aforesaid, having display compartments in which advertising media can be easily inserted and replaced.

Yet another object of this invention is to provide a display device, as aforesaid, in which access to advertising media is limited to authorized persons.

A further object of this invention is to provide a display device, as aforesaid, which can be quickly and easily attached to a pole.

A still further object of this invention is to provide a display device, as aforesaid, which can be easily adjusted vertically and circumferentially relative to a pole.

Another object of this invention is to provide a display device, as aforesaid, which can be fixedly secured to the pole of a parking meter.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
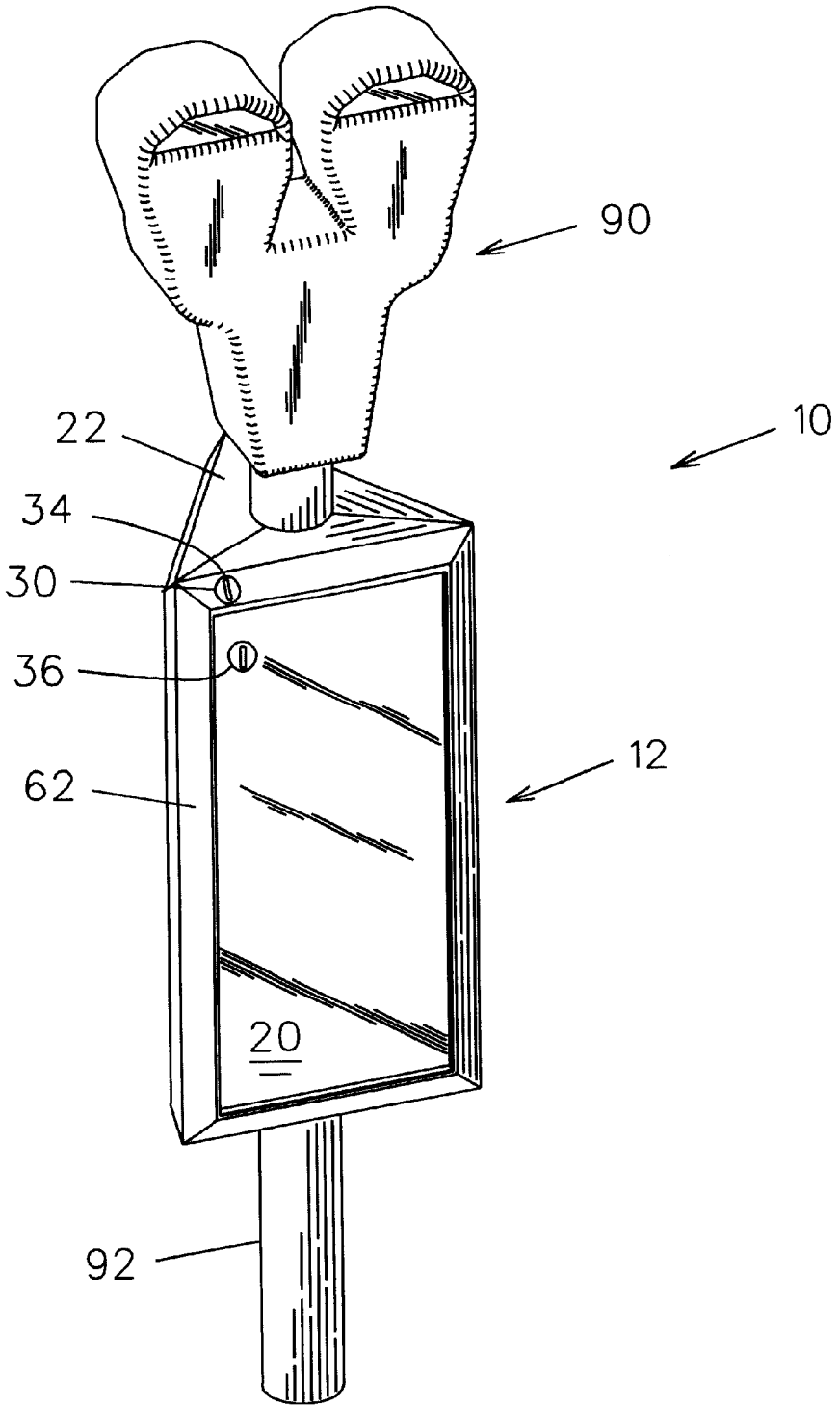
FIG. 1 is a perspective view of a display device according to the present invention coupled to a conventional parking meter.

The preferred embodiment of the multi-sided display apparatus will now be described with reference to FIGS. 1–4 of the accompanying drawings.

The display device 10 according to the invention includes first 12, second 14, and third 16 generally rectangular panels, each panel having an interior face 18 and an exterior face 20. Normal to opposing ends of each panel 12, 14, 16 are equilateral triangular upper 22 and lower 24 end walls. Each end wall 22, 24 extends in the direction of the interior face 18 of a respective panel and terminates in an apex having an arcuate recess 26 therein. The recesses 26 of the panels 12, 14, 16 cooperate to tightly surround the pole 92 of a parking meter 90 when the panels are coupled thereto as to be described more fully below. It is understood that the end walls 22, 24 are of identical size and shape as are each of the panels 12, 14, 16.

Figure 2:
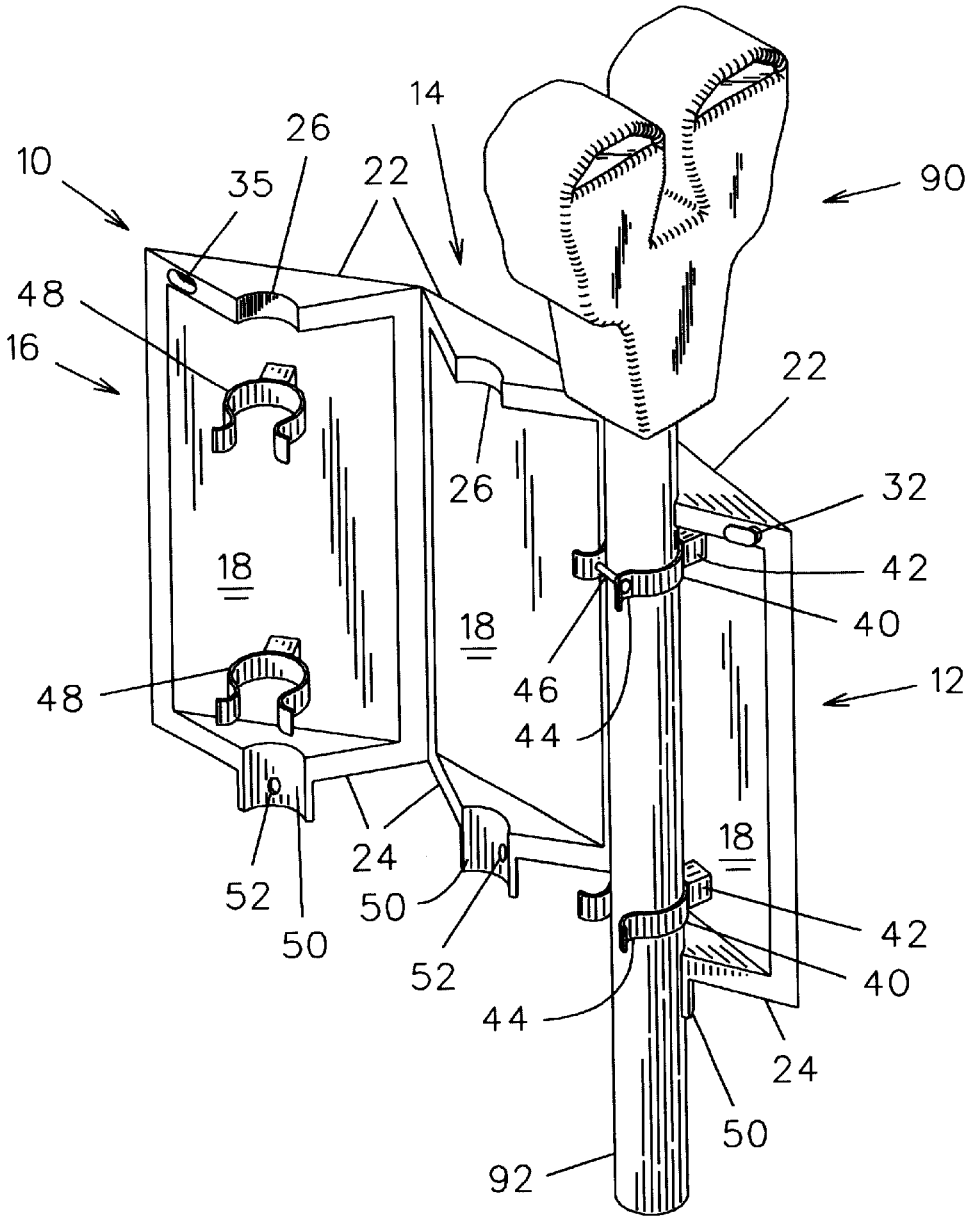
FIG. 2 is a perspective view of the display device as in FIG. 1 in an open configuration.

The first panel 12 is pivotally coupled to the second panel 14 with a hinge (not shown) or the like such that a first side edge of the first panel 12 is adjacent a first side edge of the second panel 14. Further, the second panel 14 is pivotally coupled to the third panel 16 in substantially the same manner such that a second side edge of the second panel is adjacent a first side edge of the third panel 16. As shown in FIG. 2, the first panel 12 and third panel 16 maintain free side edges.

The first and third panels 12, 16 can be releasably coupled together with a lock assembly 30 which extends through the first panel 12, the lock assembly 30 having a latch 32 which mates with a latch aperture 35 in the third panel 16 and operates in a conventional manner. A keyhole 34 is accessible from the exterior side of the first panel 12.

The base 42 of each of a pair of vertically spaced apart U-shaped mounting brackets 40 is fixedly attached to the interior face 18 of the first panel 12. The free ends 44 of each bracket 40 curve inwardly with the tips flaring outwardly. Each bracket 40 is constructed of spring steel or other resilient material such that the free ends 44 spread apart when pressed against the pole 92 of a parking meter 90 and then return to a normal position to hold the pole 92 in place upon complete insertion (FIG. 2). A bolt 46 may optionally be extended through the free ends 44 of a bracket 40 and secured therein with a nut for tightening the bracket about the pole 92 as desired by a user.

Additional brackets 48 may be mounted to the third panel 16 in substantially the same manner as described above. However, the additional brackets 48 are vertically offset from the vertical level of the brackets 40 on the first panel 12 (FIG. 3) so as not to interfere therewith when both panels 12, 16 are coupled to the pole 92.

Figure 3:
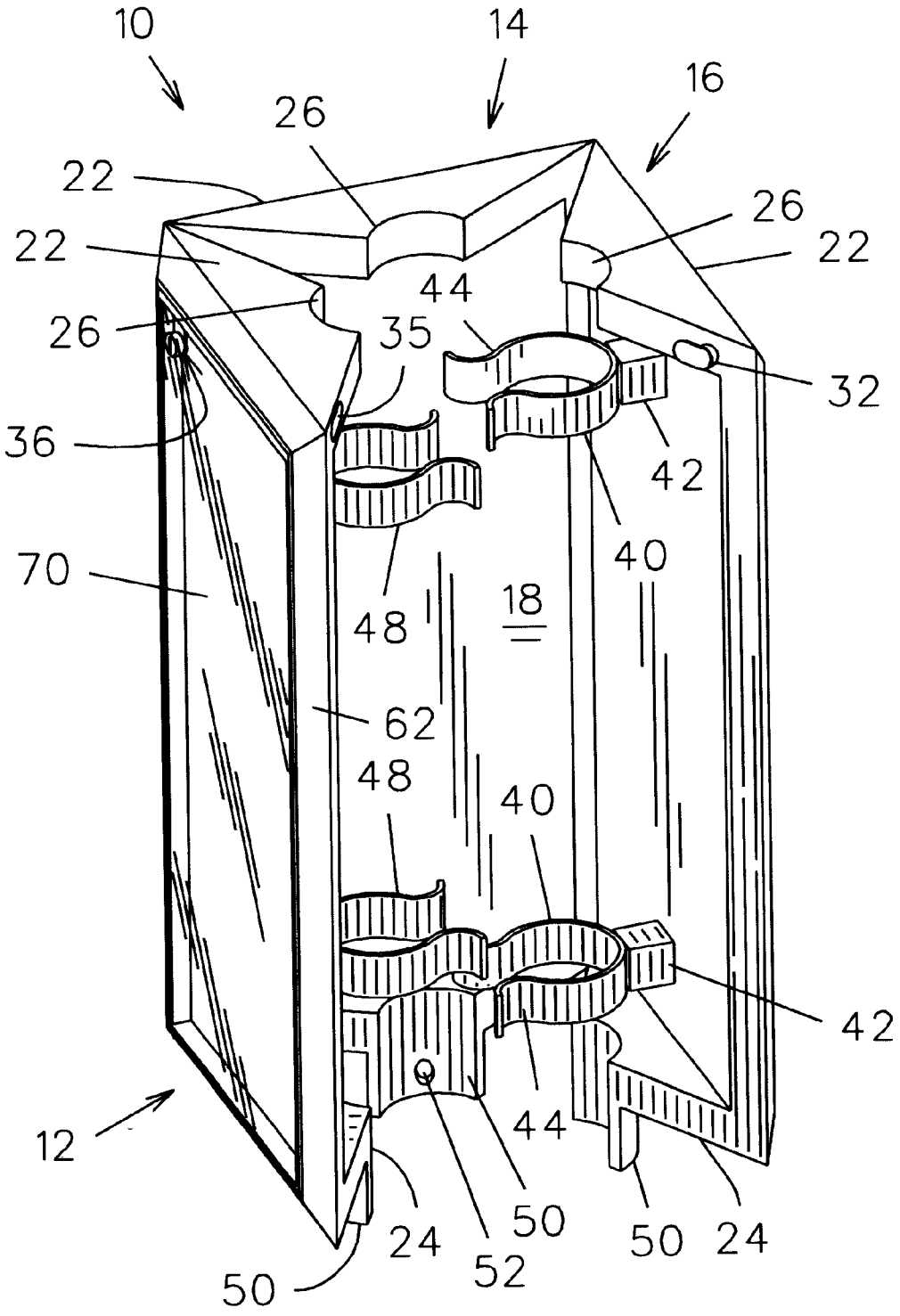
FIG. 3 is a perspective view of the display device removed from the parking meter.
Figure 4:
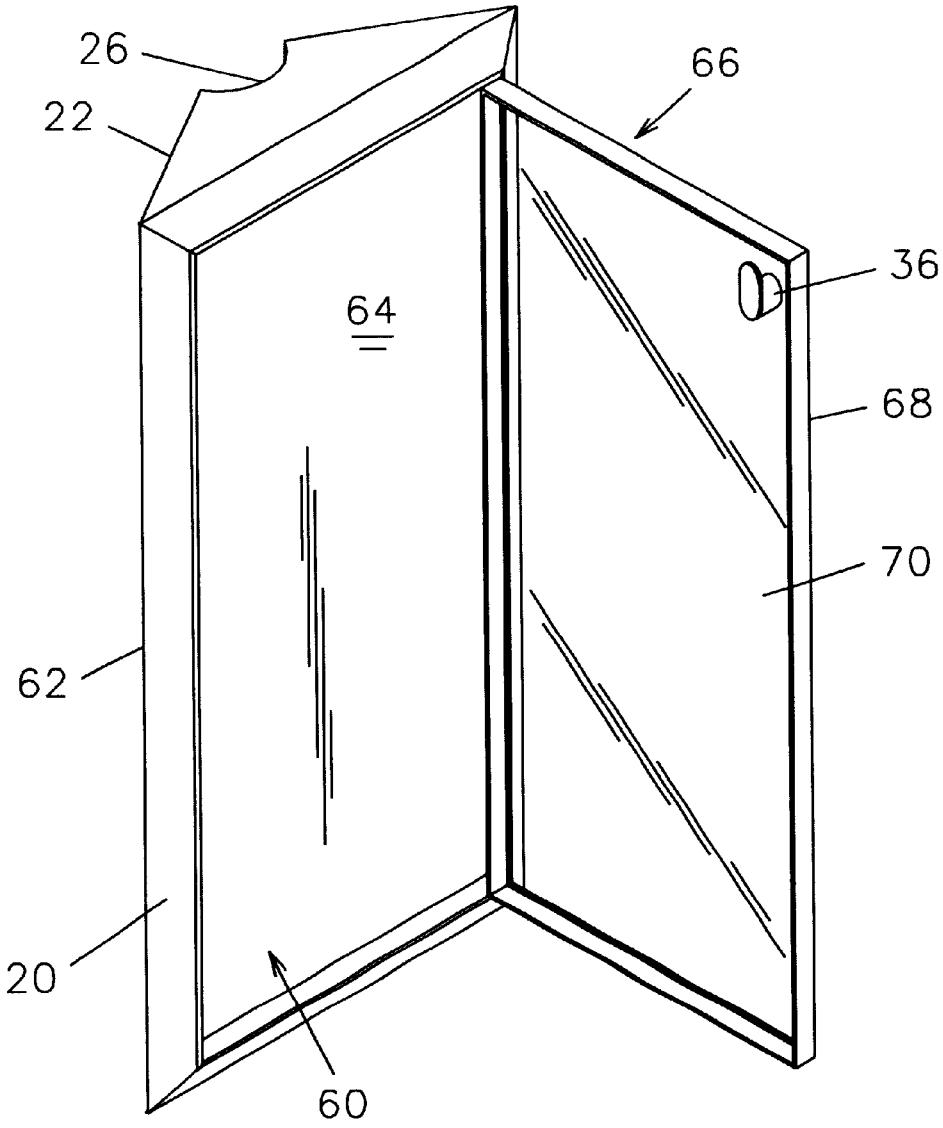
FIG. 4 is a perspective view of a panel of the display device with the display compartment door in an open configuration.

Each panel 12, 14, 16 also includes an arcuate collar portion 50 depending from the lower end wall 24 thereof. When the panels 12, 14, 16 are pivoted to a closed position wherein the brackets 40, 48 of the first 12 and third 16 panels are coupled to the pole 92, the collar portions 50 are adjacent one another and configured so as to tightly surround the pole 92. Each collar portion 50 includes an aperture 52 such that the collar portion 50 can be secured to the pole 92 with a screw or other suitable fastener. It should also be observed that the collar portions 50 provide a base to support the display device 10 when removed from a parking meter 90 as shown in FIG. 3.

The exterior face 20 of each panel 12, 14, 16 includes a display compartment 60 having a frame 62 extending outwardly from a mounting surface 64. The mounting surface 64 is constructed of a cork material to which posters, advertisements, or other advertising media may be pinned or tacked. A door 66 having a frame 68 is pivotally coupled to a side of the compartment frame 62 such that the door 66 can be opened for inserting or replacing advertising material in the compartment 60. The door 66 includes a window 70 constructed of glass, Plexiglas, or transparent plastic material through which advertising media within the compartment 60 may be viewed. The door 66 also includes a lock assembly 36 for restricting access to the compartment 60 to authorized persons.

Figure 5:
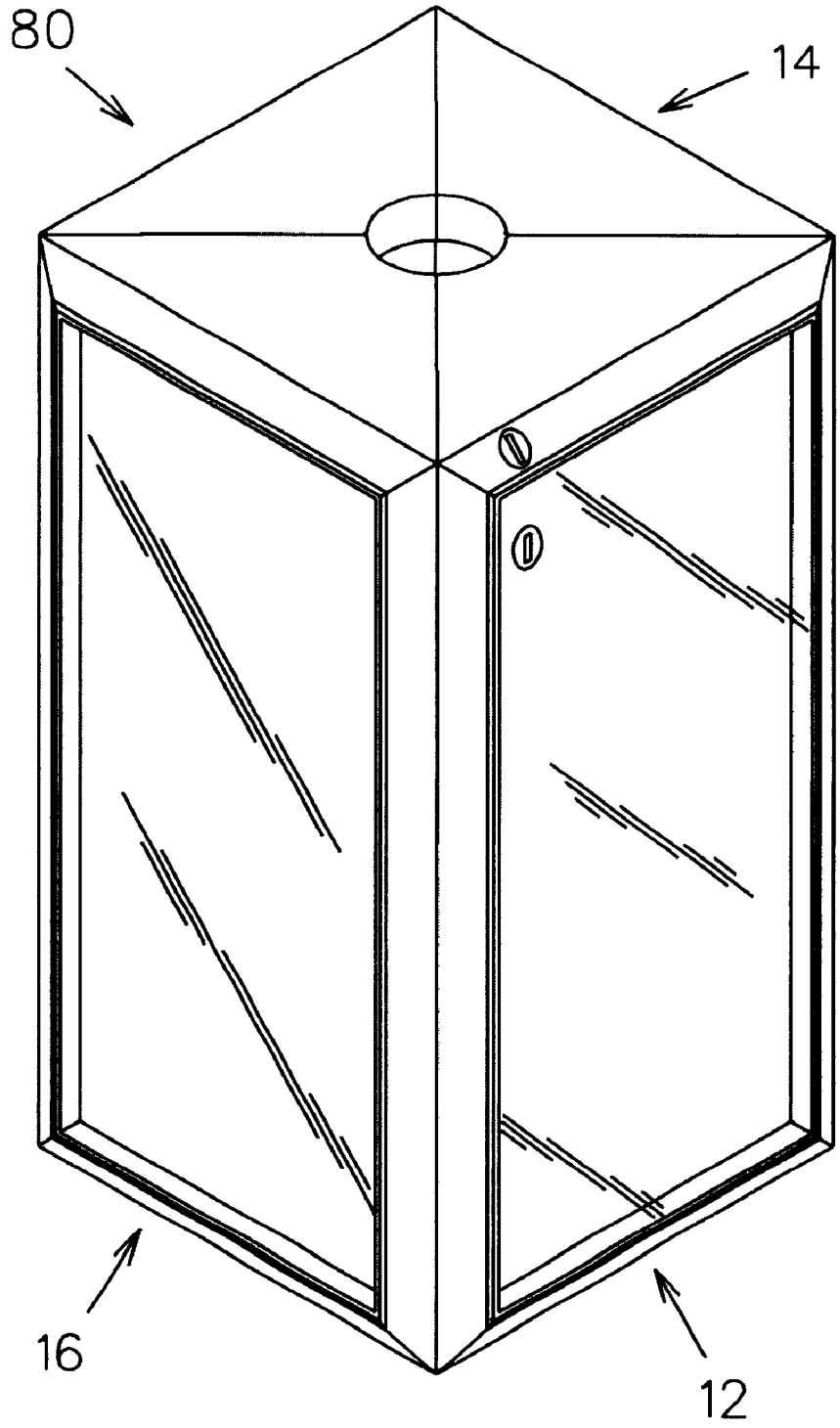
FIG. 5 is a perspective view of an alternative embodiment of the display device having four panels in a closed configuration.
Figure 6:
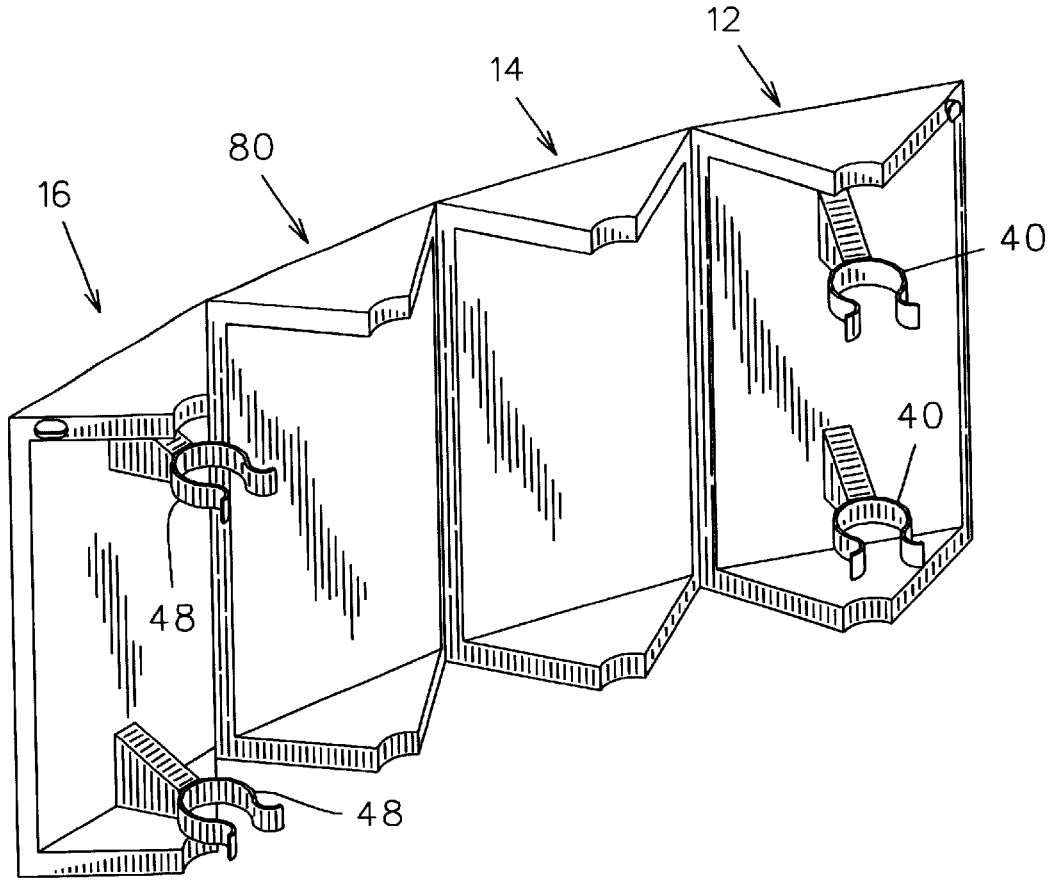
FIG. 6 is a perspective view of the display device as in FIG. 5 in an open configuration.

An alternative embodiment of the display device is shown in FIGS. 5 and 6 and is substantially similar to the device described above except as specifically noted below. The display device may include a fourth panel 80. This is accomplished by adding an additional intermediate panel between the second 14 and third 16 panels. The fourth panel 80 is pivotally connected to the adjacent panels as described above. It should be appreciated that additional intermediate panels can be included if desired.

In use, the three panels 12, 14, 16 in an open configuration are mounted to the pole 92 of a parking meter 90 (FIG. 2). Mounting is accomplished by pressing the U-shaped mounting brackets 40 of the first panel 12 against the pole 92 until the pole is completely inserted therein. A bolt 46 may be inserted through the ends 44 of the bracket 40 and tightened with a nut for tightly securing the bracket 40 to the pole 92. The first panel 12 can be adjusted vertically or circumferentially by loosening the bolt 46 and sliding or rotating the bracket 40, respectively, relative to the pole 92. Then the second 14 and third 16 panels are pivoted toward the pole 92 until the brackets 48 of the third panel 16 engage the pole 92. The lock assembly 30 may be operated with a key for coupling the third panel 16 to the first panel 12. Further, screws may be inserted through the collar portion apertures 52 for fixedly securing the panels 12, 14, 16 to the pole 92.

Once the display device 10 is secured to the pole 92, selected advertising media can be inserted into the display compartments 60. The door 66 of a panel is pivotally opened and a desired display piece is placed within the compartment 60 and tacked to the cork surface if desired. The door 66 is closed and locked by operating the lock assembly 36. The display piece can be viewed through the window 70. When properly positioned on a pole 92 of a parking meter 90, one panel is viewable from the street or parking stall, while the other panels are viewable by pedestrians walking in either direction on an adjacent sidewalk.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A multi-sided display device for mounting to a pole, comprising:

a first panel having interior and exterior faces and a latch;

a second panel pivotally attached to said first panel;

a third panel pivotally attached to said second panel, said third panel defining an aperture adapted to releasably mate with said latch of said first panel;

wherein each of said first, second, and third panels includes spaced apart generally triangular end walls, each of said panels having a rectangular configuration extending between and secured at each end to respective sides of said end walls;

a fastener fixedly attached to said interior face of said first panel for releasably coupling said first panel to said pole, whereby said first, second, and third panels selectably pivot between a closed configuration wherein said third panel is coupled to said first panel and an open configuration wherein said second and third panels are pivoted away from said first panel.

2. A display device as in claim 1 further comprising a second fastener fixedly attached to an interior face of said third panel for releasably coupling said third panel to said pole when said first, second, and third panels are in said closed configuration.

3. A display device as in claim 1 wherein said fastener is a resilient U-shaped mounting bracket.

4. A display device as in claim 1 wherein each of said first, second, and third panels includes an arcuate flange depending from a respective said end wall adapted to engage said pole when said panels are in said closed configuration, each said flange having an aperture adapted to receive a screw for securing said respective end wall to said pole.

5. A display device as in claim 1 wherein said second and third panels include an exterior face, said device further comprising a door pivotally coupled to each said exterior face of said first, second, and third panels, said door being spaced apart from a respective said exterior face to form a compartment therebetween for retaining a selected display piece, said door including a window for viewing said display piece.

6. A display device as in claim 1 wherein said first panel includes a lock assembly adapted to secure said first panel to said third panel in said closed configuration.

7. A multi-sided display device for mounting to a pole, comprising:

a casing having a plurality of panels including a first panel and a terminal panel coupled to said first panel and at least one intermediate panel therebetween, each panel being coupled to an adjacent panel and having upper and lower end walls and interior and exterior faces such that said casing defines an interior space;

wherein said at least one intermediate panel comprises first and second intermediate panels that are pivotally coupled one to the other and to said first and terminal panels, whereby said plurality of panels selectably pivot between a closed configuration wherein said terminal first panel is releasably coupled to said first terminal panel with a latch and an open configuration wherein said intermediate and terminal panels are pivoted away from said first panel;

a fastener attached to said interior face of at least one of said plurality of panels adapted to mount said casing to a pole, said pole extending longitudinally through said interior space of said casing; and a door pivotally coupled to said exterior face of each of said plurality of panels, said door including a window for viewing a selected display piece.

8. A display device as in claim 7 wherein said at least one fastener is a resilient U-shaped mounting bracket.

9. A display device as in claim 7 wherein said exterior faces are constructed of a cork material.

10. A display device as in claim 7 wherein said end walls include apertures adapted to tightly surround said pole when said casing is mounted thereto.

11. A display device as in claim 7 wherein said first panel includes a lock assembly adapted to lock said first panel to said terminal panel in said closed configuration.

12. A display device as in claim 7 wherein each of said plurality of panels includes an arcuate flange depending from a respective said lower end wall adapted to bear against said pole, each said flange having an aperture adapted to receive a screw for securing said respective lower end wall to said pole.

13. A display device as in claim 7 wherein said door includes a lock assembly adapted to selectively lock said door to said exterior surface.

14. A multi-sided display device for mounting to a pole of a parking meter, comprising:

a casing further comprising:

spaced apart equilateral triangular end walls; and three rectangular side panels extending between and secured at each end to a respective side of said end walls, each side panel having an interior side and an exterior side;

wherein said panels include a first panel and a terminal panel with an intermediate panel pivotally coupled to said first and terminal panels, said terminal panel being releasably coupled to said first panel with a latch;

a resilient U-shaped clamp mounted to said interior side of at least one of said side panels for mounting said casing to said pole, said clamp including a bolt for tightening free ends of said clamp about said pole.

15. A display device as in claim 14 further comprising a door pivotally coupled to said exterior side of each side panel, said door being spaced apart from said exterior side to form a compartment therebetween for retaining a selected display piece, said door including a window for viewing said display piece.

16. A display device as in claim 14 wherein said first panel includes a lock assembly adapted to selectively secure said first panel to said terminal panel.

17. A display device as in claim 14 wherein said exterior side is formed of a cork material.

* * * * *

UNITED STATES PATENT AND TRADEMARK OFFICE

CERTIFICATE OF CORRECTION

PATENT NO. : 6,250,003 B1
DATED : June 26, 2001
INVENTOR(S) : Jeff B. Phinney

It is certified that error appears in the above-identified patent and that said Letters Patent is hereby corrected as shown below:

Title page,
Inventor's country, change "CA" into -- CN --.

Signed and Sealed this

Fifteenth Day of January, 2002

*Attest:*

*Attesting Officer*

JAMES E. ROGAN
*Director of the United States Patent and Trademark Office*